US005557864A

United States Patent [19]

Marks

[11] Patent Number: 5,557,864

[45] Date of Patent: Sep. 24, 1996

[54] FOOTWEAR FASTENING SYSTEM AND METHOD OF USING THE SAME

[76] Inventor: Lloyd A. Marks, 301 Roanoke Rd., Westfield, N.J. 07090

[21] Appl. No.: 383,842

[22] Filed: Feb. 6, 1995

[51] Int. Cl.[6] ..... A43C 11/00; A44B 18/00

[52] U.S. Cl. ..... 36/50.1; 36/50.5; 24/306

[58] Field of Search ..... 36/50.1, 114, 115, 36/50.5, 51; 24/306, 713.4, 713.7

[56] References Cited

U.S. PATENT DOCUMENTS

| | | | |
|---|---|---|---|
| 910,771 | 1/1909 | Assorati . | |
| 1,670,468 | 5/1928 | Martin et al. . | |
| 3,131,490 | 5/1964 | Kowen | 12/113 |
| 3,205,544 | 9/1965 | Streule et al. . | |
| 3,731,350 | 5/1973 | Diebold | 36/50.1 |
| 4,308,672 | 1/1982 | Antonious | 36/50 |
| 4,907,352 | 3/1990 | Ginsberg . | |
| 5,203,053 | 4/1993 | Rudd . | |

FOREIGN PATENT DOCUMENTS

| | | | |
|---|---|---|---|
| 2501977 | 9/1982 | France | 36/50.1 |
| 716287 | 1/1942 | Germany | 36/50.1 |
| 431215 | 12/1948 | Italy | 36/50.1 |

*Primary Examiner*—Paul T. Sewell
*Assistant Examiner*—Marie Denise Patterson
*Attorney, Agent, or Firm*—Wigman, Cohen, Leitner & Myers, P.C.

[57] ABSTRACT

A footwear fastening system and a method of converting lace fastened footwear to hook-and-loop fastened footwear comprising hook-and-loop fastener strips which are secured to the footwear by means of a lace which passes through adjacent eyelets along each upper side of the footwear. The fastener strips are anchored to one upper side with the lace and are passed beneath the lace on the other upper side and tensioned to draw the upper sides together into a snug fit. Tubular posts may be disposed between the eyelets and laced to the upper sides by the lace.

22 Claims, 3 Drawing Sheets

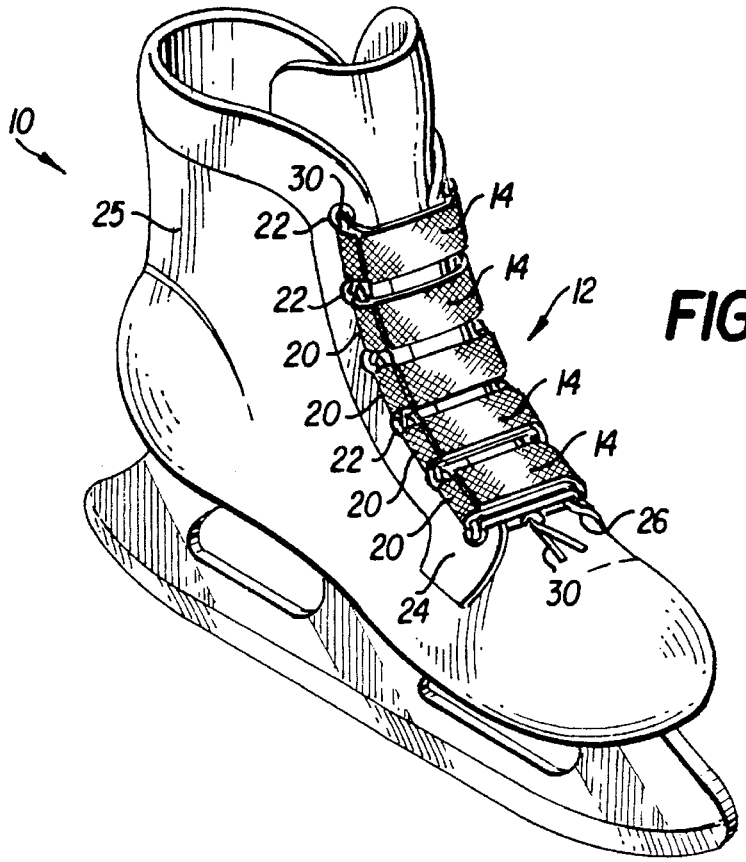
FIG. 1
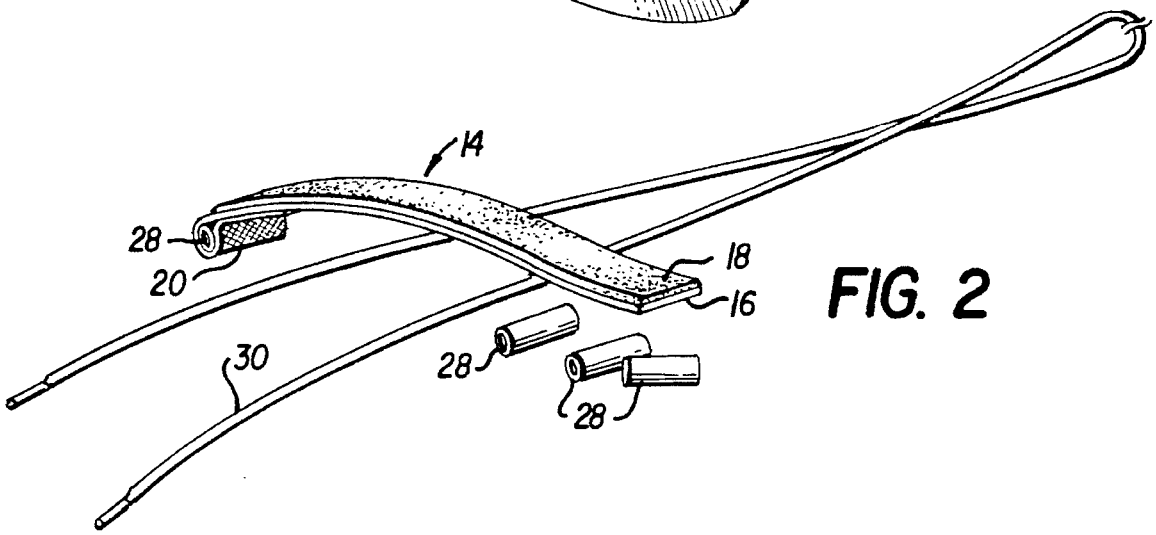
FIG. 2
FIG. 3A
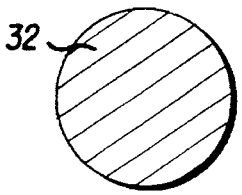
FIG. 3B
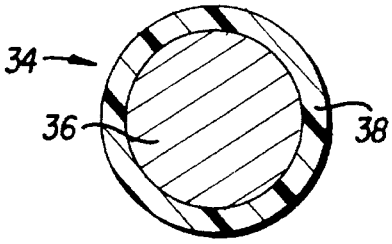

FIG. 4
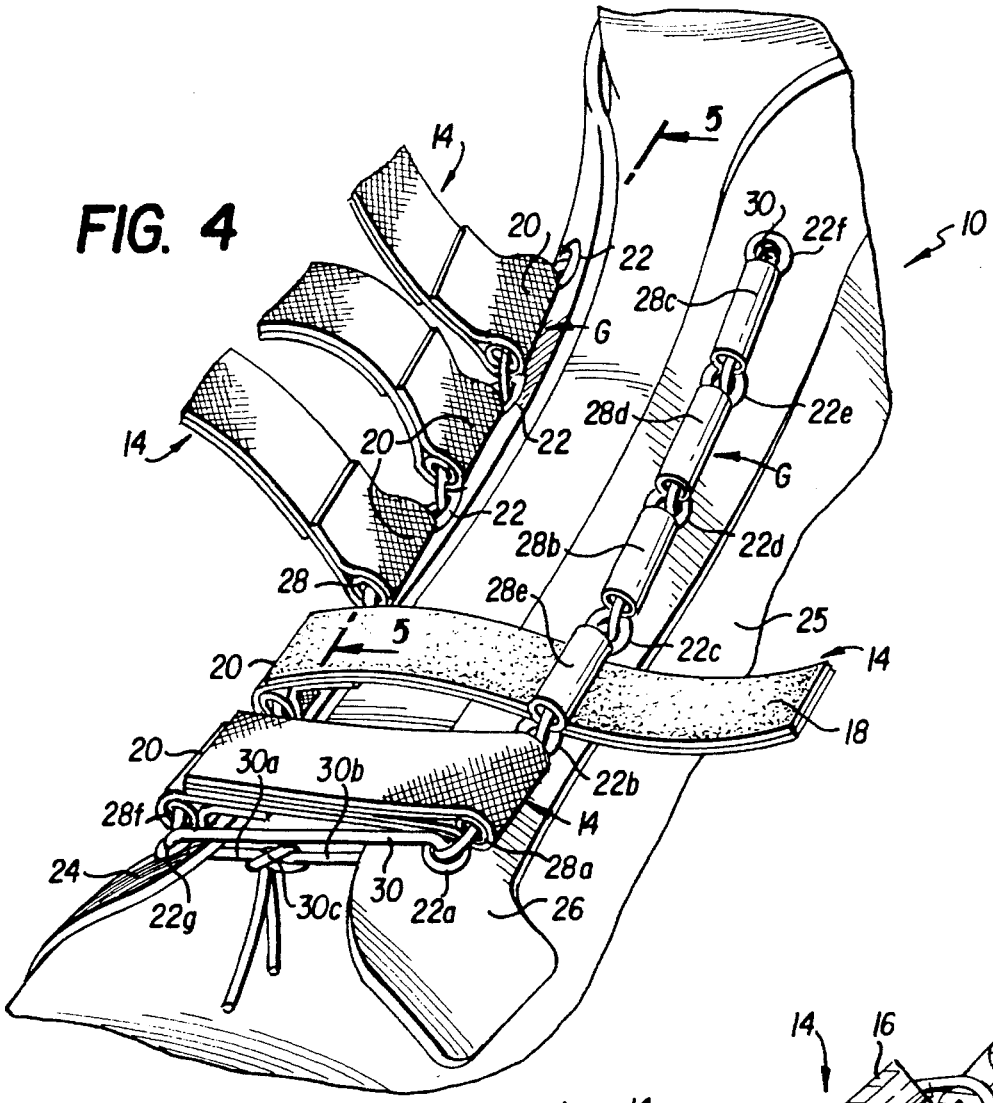
FIG. 5
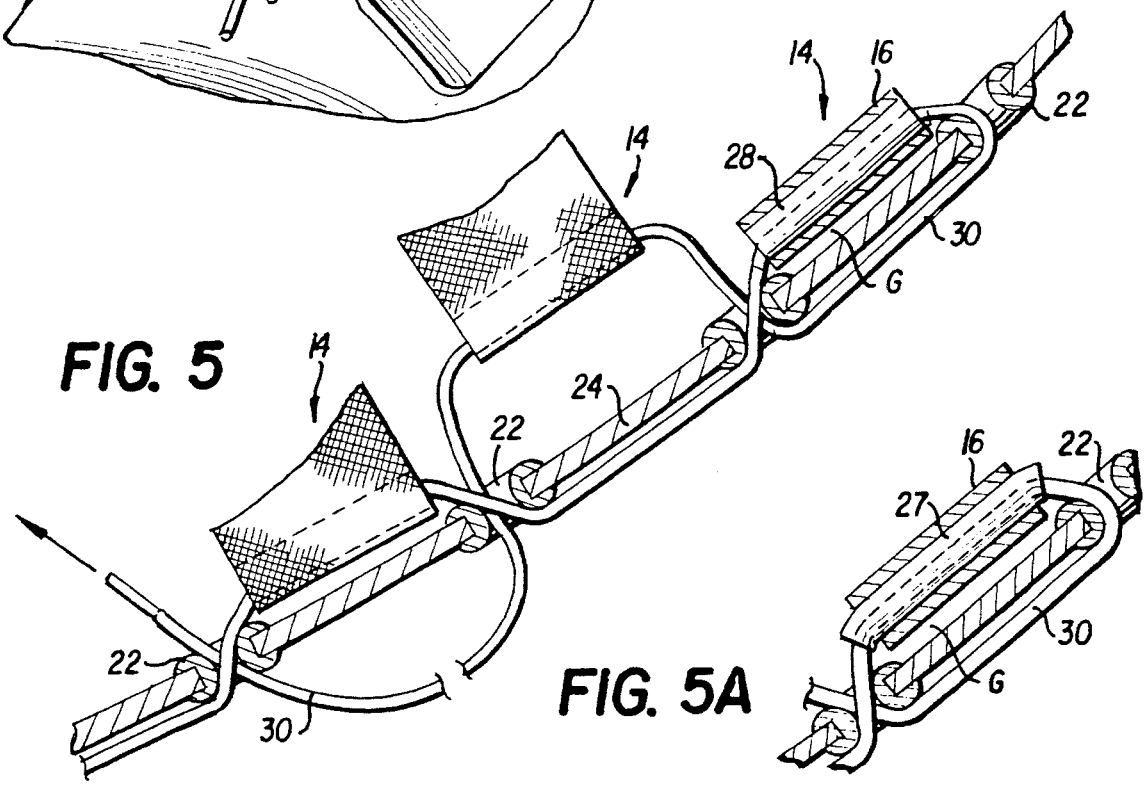
FIG. 5A

FOOTWEAR FASTENING SYSTEM AND METHOD OF USING THE SAME

FIELD OF THE INVENTION

The present invention relates to footwear and more particularly to a hook-and-loop fastening system for footwear, especially athletic footwear, such as sneakers, ice and roller skates and hiking boots, and a method of converting conventional laced footwear to footwear secured with the hook-and-loop fastening system.

BACKGROUND OF THE INVENTION

It is well-known and conventional to use hook-and-loop fasteners, such as Velcro® fasteners, to secure footwear on the feet of the wearer. Many types of footwear presently on the market employ some form of permanently attached hook-and-loop fasteners, especially casual footwear such as sneakers, walking shoes, childrens' shoes and the like. It is also known in the art to replace conventional shoelace fasteners for footwear with hook-and-loop type fasteners or closures. Exemplary of such hook-and-loop shoe closure devices which are used to replace shoelaces are disclosed in U.S. Pat. Nos. 3,205,544; 4,907,352; and 5,203,053. The hook-and-loop fasteners in the devices disclosed in the aforesaid patents are secured to the shoelace eyelets by means of screws, rivets or spring wire clips. Such securing devices disadvantageously require special tools to fabricate or install.

Lace-type footwear has also been converted to zipper-type footwear by securing a zipper fastener to the lace eyelets of the footwear. U.S. Pat. Nos. 910,771 and 1,670,468 are exemplary of such shoe and boot fasteners. In those fastener devices, conventional laces are used to secure the zipper fastener in place.

One problem associated with athletic footwear fastened with laces, especially ice and roller skates, is the loosening of the fit after a relatively short time of use which requires retightening of the laces. Hook-and-loop fasteners facilitate tightening of the fit rapidly and with little or no interruption in the athletic endeavor. Such hook-and-loop fasteners also make it easier for children to tighten the fit of athletic footwear, such as ice and roller skates, and thereby prevent possible injury as a result of loosely fitting skates.

It would be desirable therefore to provide a simple, economical hook-and-loop system that could be used to readily convert lace fastened footwear to hook-and-loop fastened footwear without the use of any tools.

SUMMARY OF THE INVENTION

The present invention is directed to a footwear fastening system and a method of converting lace fastened footwear to hook-and-loop fastened footwear. In one form, the footwear fastener system of the invention comprises a conversion kit including one or more hook-and-loop fastener strips, a lace means and preferably a plurality of tubular posts for securing the fastener strips to the footwear eyelets. The hook-and-loop fastener strips are preferably a Velcro® fastener, and most preferably a fastener having a fastener pile containing both hooks and loops, such as, for example, the fastener pile known as Omnitape or that disclosed in U.S. Pat. No. 5,231,738.

In its simplest form, the conversion kit includes one hook-and-loop fastener strip with a loop formed in one end thereof and a lace. The lace is passed through the lace eyelets of a footwear and the loop of the fastener to secure the fastener to one side of the footwear upper and to provide a post on the other side of the footwear upper about which the fastener strip can be passed and used to draw together the sides of the footwear upper to a desired snugness. The strip is then secured to itself by means of the hook-and-loop fastener pile.

In a preferred embodiment of the invention, especially for use with athletic footwear such as ice and roller skates, a plurality of hook-and-loop fastener strips are used and a plurality of tubular posts are laced to the footwear between the eyelets with a lace means. The post provides additional support for anchoring each fastener strip to one side of the upper and provides a more rigid post as well as a smooth cylindrical surface over which the fastener strip is guided as it is tensioned and secured to itself. The lace means may be a conventional footwear lacing of any suitable material such as leather, fabric, a multifilament or monofilament polymeric material. The lace means may also comprise solid or stranded metal wire which may be coated with a polymeric material with a low coefficient of friction, such as PTFE or the like, to reduce friction between the fastener strip and the lace means.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 1 is a perspective view of an ice skate footwear illustrating the use of the present invention;

FIG. 2 is a perspective view showing the components of the present invention that may be incorporated in a conversion kit;

FIG. 3A is a cross-section of one embodiment of the lace means of the present invention;

FIG. 3B is a cross-section of another embodiment of the lace means of the present invention;

FIG. 4 is a fragmentary perspective view of footwear showing the manner in which the fastener of the invention is secured to the footwear;

FIG. 5 is a cross-section view taken along line 5—5 of FIG. 4 showing further details of the attachment of the components of the present invention to the footwear;

FIG. 5A is a cross-section view similar to FIG. 5 showing a modification of the components of the present invention.

DETAILED DESCRIPTION OF THE INVENTION

Figure 6:
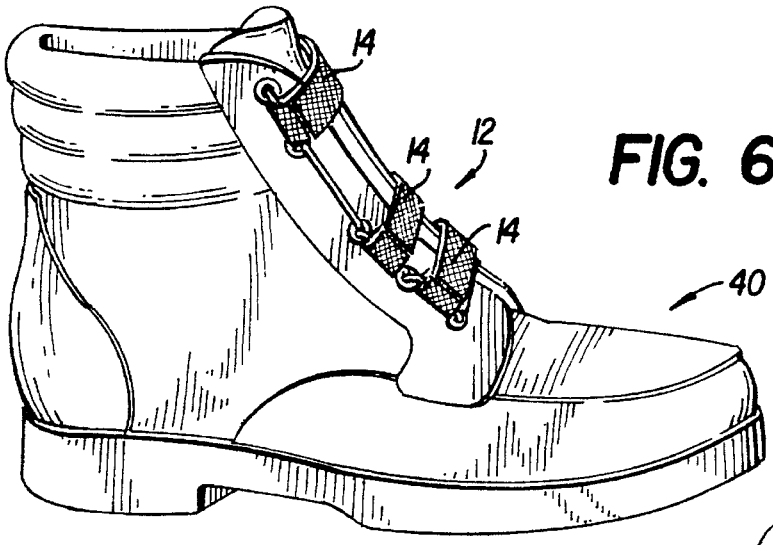
FIGS. 6–8 are perspective views of various types of footwear illustrating the manner of using the invention for hiking boots, sneakers and in-line roller skates.

Referring now to the drawings wherein like parts are designated by like reference numerals throughout, there is illustrated in the perspective view of FIG. 1 an ice skate footwear designed generally by reference numeral 10 which incorporates the hook-and-loop fastener system 12 of the present invention. Referring also to FIG. 2, system 12 comprises a plurality of fastener strips 14 which are preferably made of a hook-and-loop fabric 16 having a fastener pile 18 of hooks and loops formed on one side of the strip 14. The fastener pile is preferably the aforesaid Omnitape hook-and-loop fastener. One end of each strip 14 is formed with a loop 20 for a purpose to be described hereinafter. Loop 20 may be formed at one end of the strip and permanently secured by sewing, bonding, double-sided adhesive tape or any other suitable or appropriate means or temporarily secured by hook-and-loop fastener material or the like.

Footwear 10 is constructed in a conventional manner with a plurality of eyelets 22 inserted along the edge of each side 24, 26 of the footwear upper 25. A plurality of tubular posts 28 made of a metal, such as aluminum or steel, or of a plastic material are provided, some of which are inserted in the loops 20 at one end of each strip 14 as shown in FIG. 2. The tubular posts 28 in the loops 20 are laced to one side 24 of the footwear upper 25 between adjacent eyelets 22 using lace means 30, such as a conventional fabric bootlace. Similarly, tubular posts 28 are laced to the other side 26 of the footwear upper 25 between adjacent eyelets 22 with lace means 30. It will be understood that the tubular posts 28 may be fastened to the upper side 24 and the loops 20 formed about the posts after the posts are fastened.

Lace means 30 may also comprise other suitable flexible strands, including metal, leather, monofilament and multifilament polymeric materials and the like. FIG. 3A illustrates a cross-sectional view of a lace 32 which comprises a solid or stranded round metal wire. FIG. 3B illustrates in cross-section another lace 34 which comprises a solid or stranded round metal wire core 36 coated with a layer 38 of polymeric material having a low coefficient of friction, such as PTFE polytetrafluoroethylene, or the like.

Now referring to FIGS. 4 and 5, the method of attaching the fastener system 12 of the invention to footwear 10 will be described. First, the conventional lacing of the footwear is removed. Then, lace 30 is passed seriatim through eyelet 22*a* from the inside of upper side 26, through tubular post 28*a*, through eyelet 22*b* from the outside, through eyelet 22*c* from the inside, through tubular post 28*b*, through eyelet 22*d* from the outside, through eyelet 22*e* from the inside, through tubular post 28*c*, through eyelet 22*f* from the outside, through eyelet 22*e* from the inside, through tubular post 28*d*, through eyelet 22*d* from the outside, through eyelet 22*c* from the inside, through tubular post 28*e*, through eyelet 22*b* from the outside and through eyelet 22*a* from the inside. From eyelet 22*a*, lace 30 is drawn transversely across to upper side 24, and laced through eyelet 22*g*, and then through all the eyelets 22 and tubular posts 28 in loops 20 in the same manner as on upper side 26. After the free end 30*a* of lace 30 is passed back through eyelet 22*g* from the lowermost tubular post 28*f*, it is tied with the free end 30*b* of lace 30 into a knot 30*c*. It will be appreciated by those skilled in the art that two separate laces 30 may be used, one on each upper side 24, 26 and that lace 30 may be started at the uppermost eyelet on either upper side 24 or upper side 26.

After the fastener strips 14 and tubular posts 28 have been laced to the footwear as shown in FIG. 4, the strips 14 may be used to secure the footwear 10 to the foot of the wearer. Each strip 14 is passed beneath the directly opposite tubular post 28 and pulled outwardly and upwardly to draw the two upper sides 24, 26 together. When the fit has the appropriate or desired snugness, the fastener pile 18 is pressed against itself to secure the strip in its fastened position as shown by the lowermost strip in FIG. 4. After all the strips are secured in place, individual strips may be readjusted to achieve the appropriate or desired overall snugness.

Advantageously, the smooth, rigid cylindrical surfaces of the tubular posts and the possibility of rotation of the posts about their longitudinal axes, make it particularly easy to slide the strips beneath the posts and draw the two upper sides 24, 26 together. Preferably, the tubular posts 28 have a length slightly greater than the minimum spacing between the eyelets 22 so as to create a small space or gap G (FIGS. 4 and 5) between the outer cylindrical surface of the tubular posts and the outside surface of the upper sides 24, 26. Such space or gap G further facilitates passing the strips 14 beneath the tubular posts 28 on upper side 26. Alternatively, the tubular posts may be slightly bent at each end thereof as shown by post 27 27 in FIG. 5A to provide a gap G.

Referring again to FIGS. 3A and 3B, the lace means shown therein, namely, the metal wire laces 32 and 34 may be used with or without the tubular posts 28. The advantage of using metal wires is that elongation of the laces due to tension is substantially eliminated. Moreover, the low friction coating 38 on wire 36 makes it quite easy to draw down and secure the strips 14 in a snug fitting condition.

As explained above, the components of the fastener system 12 of the invention may be packaged as a conversion kit comprising at least one fastener strip 14, a lace means 30, and at least two tubular posts 28, one of which may be preinstalled in the loop 20 of the strip 14 as shown in FIG. 2.

Figure 7:
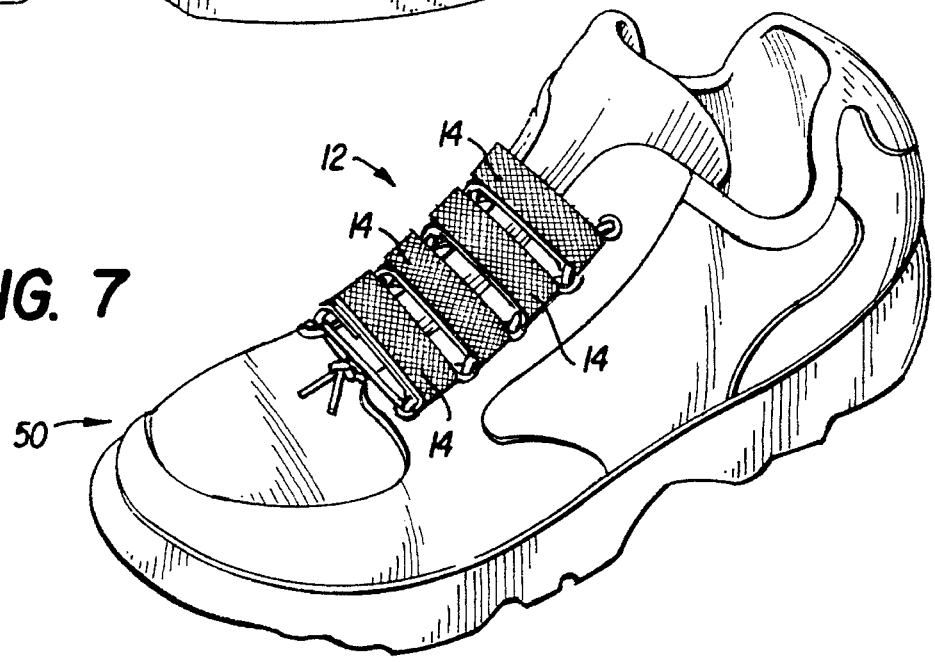
Figure 8:
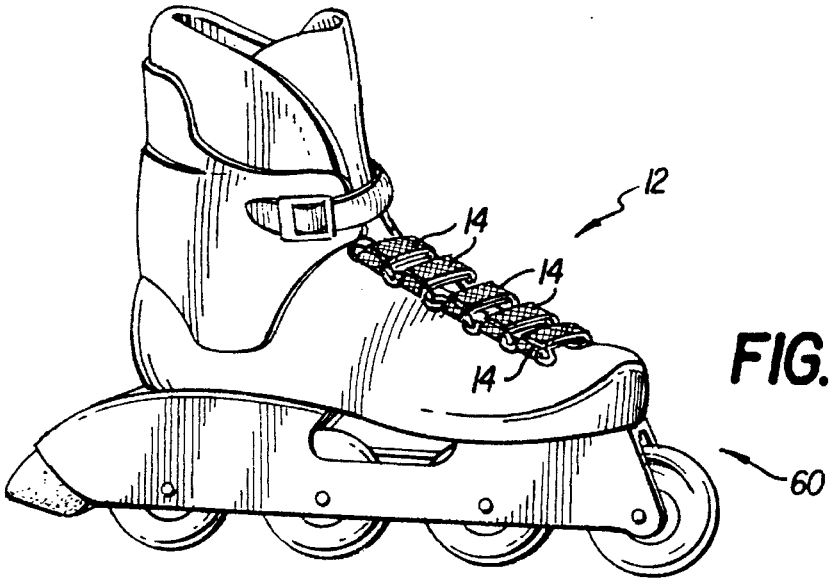

It will be appreciated by those skilled in the art that no tools are required to assemble the fastener system 12 of the invention to any lace-type footwear. While the fastener system 12 may be used on any lace-type footwear, it is especially useful on athletic footwear, such as the ice skate 10 of FIG. 1, a hiking boot 40 as shown in FIG. 6, a sneaker or running shoe 50 as shown in FIG. 7, or an in-line roller skate 60 as shown in FIG. 8. With reference to FIG. 6, it is possible to omit a fastener strip between adjacent eyelets. It will also be appreciated that the fastener pile 18 (FIG. 4) may comprise separate hook portions and loop portions spaced from one another along the length of fastener strip 14.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

I claim:

1. A footwear fastener system for securing footwear having opposed upper sides and a plurality of lace eyelets in said upper sides, said fastener system comprising at least one hook-and-loop fastener strip, first lace means for lacing said fastener strip to the eyelets of one of said upper sides and second lace means for lacing between the eyelets of the other upper side, said fastener strip including a loop at one end thereof, a first tubular post disposed in said loop, said first lace means passing through said loop and said first tubular post, a second tubular post disposed between a pair of eyelets of the other upper side, said second lace means passing through said second tubular post.

2. The footwear fastener system of claim 1, wherein said first and second lace means comprise a lace from the group consisting of a fabric lace, a polymeric monofilament lace, a polymeric multifilament lace, a solid metal wire lace, a stranded metal wire lace and a leather lace.

3. The footwear fastener system of claim 1, wherein said first and second lace means comprise only one metal wire lace having a low coefficient of friction coating thereon.

4. The footwear fastener system of claim 3, wherein said metal wire lace is a stranded wire and said coating is polytetrafluoroethylene.

5. The footwear fastener system of claim 1, wherein said tubular posts have a circular cross-section.

6. The footwear fastener system of claim 5, wherein said posts are made of a material from the group consisting of aluminum, steel and plastic.

7. The footwear fastener system of claim 1, wherein said posts are bent at the ends thereof.

8. The footwear fastener system of claim 1, wherein said hook-and-loop fastener strip comprises only one fastener pile including both hooks and loops.

9. The footwear system of claim 1 in combination with a shoe upper, including at least three lace eyelets in each upper side, said first lace means passing through all eyelets of said one upper side and said second lace means passing through all eyelets of said other upper side.

10. A method of converting lace fastened footwear to hook-and-loop fastened footwear, said footwear comprising opposed upper sides and a plurality of lace eyelets in each of said upper sides, comprising the steps of:

providing at least one hook-and-loop fastener strip with a loop in one end thereof, at least first and second tubular posts and at least one lace;

inserting said first tubular post into said loop;

passing said lace through one eyelet, through said second tubular post and then through an adjacent eyelet along one of said upper sides such that said second tubular post extends between said adjacent eyelets of said one upper side;

passing said lace through one eyelet, through said first tubular post and said loop in said fastener strip and then through an adjacent eyelet along the other of said upper sides to secure said fastener strip between said adjacent eyelets;

passing said strip beneath and about the second tubular post between adjacent eyelets of said one upper side; and drawing said opposed upper sides together with said strip and fastening said hook-and-loop fastener strip to itself.

11. In combination with footwear comprising opposed upper sides each having a plurality of lace eyelets disposed therein, a footwear fastener system comprising a hook-and-loop fastener strip with a loop in one end thereof, first and second tubular posts and a lace, said first tubular post being disposed in said loop, said lace being laced through the eyelets of each upper side such that said lace extends through said first and second tubular posts disposed between adjacent eyelets along each of said upper sides, said lace passing through the first tubular post and said loop of said strip to secure said strip to one of said upper sides between adjacent eyelets, said strip being adapted to pass beneath the second tubular post extending between adjacent eyelets on the other of said upper sides.

12. The combination of claim 11, wherein said lace comprises a lace from the group consisting of a fabric lace, a polymeric monofilament lace, a polymeric multifilament lace, a solid metal wire lace, a stranded metal wire lace and a leather lace.

13. The combination of claim 11, wherein said tubular posts have a circular cross-section and a length greater than the minimum spacing between the lace eyelets of said footwear.

14. The combination of claim 11, wherein said posts are bent at the ends thereof.

15. The combination of claim 11, wherein said lace comprises a metal wire lace having a low coefficient of friction coating thereon.

16. The combination of claim 15, wherein said metal wire lace is a stranded wire and said coating is polytetrafluoroethylene.

17. The combination of claim 11, wherein said footwear comprises an ice skate.

18. The combination of claim 11, wherein said footwear comprises a roller skate.

19. The combination of claim 11, wherein said footwear comprises a hiking boot.

20. The combination of claim 11, wherein said footwear comprises a sneaker.

21. The combination of claim 11, wherein each upper side has at least three lace eyelets, said lace passing through all of said eyelets.

22. In combination with footwear comprising first and second opposed upper sides each having inner and outer surfaces, an edge and a plurality of lace eyelets disposed along the edge thereof, a footwear fastener system comprising a lace laced in and out through adjacent eyelets in the edges of the first and second upper sides in a first direction and laced in and out through adjacent eyelets in the edges of the first and second upper sides in a second direction such that said lace passes twice through each eyelet and extends between adjacent eyelets of each upper side on both the inner and outer surfaces thereof, a hook-and-loop fastener strip having a loop in one end thereof, the lace extending between a pair of adjacent eyelets on said first upper side passing through said loop, said strip passing around the lace extending between a pair of adjacent eyelets on said second upper side and being fastened to itself.

* * * * *